United States Patent [19]

Hölttä

[11] Patent Number: 5,074,501

[45] Date of Patent: Dec. 24, 1991

[54] DEVICE FOR SUPPORTING OF THE HAND

[75] Inventor: Seppo Hölttä, Siilinjärvi, Finland

[73] Assignee: Silin Metalli KY, Siilinjärvi, Finland

[21] Appl. No.: 438,414

[22] PCT Filed: Jun. 29, 1988

[86] PCT No.: PCT/FI88/00105

§ 371 Date: Dec. 6, 1989

§ 102(e) Date: Dec. 6, 1989

[87] PCT Pub. No.: WO89/00111

PCT Pub. Date: Jan. 12, 1989

[30] Foreign Application Priority Data

Jun. 30, 1987 [FI] Finland ..... 872875

[51] Int. Cl.[5] ..... B43L 15/00

[52] U.S. Cl. ..... 248/118.3; 248/281.1

[58] Field of Search ..... 248/118, 118.1, 118.3, 248/118.5, 278, 281.1, 585

[56] References Cited

U.S. PATENT DOCUMENTS

| | | | |
|---|---|---|---|
| 389,053 | 9/1888 | Brown | 248/118.3 |
| 2,424,222 | 7/1947 | Brown et al. | 248/278 |
| 3,124,328 | 3/1964 | Kortsch . | |
| 3,929,309 | 12/1975 | De Vore | 248/118 |
| 4,470,106 | 9/1984 | Norton | 248/278 X |
| 4,592,526 | 6/1986 | Kobelt | 248/278 |

FOREIGN PATENT DOCUMENTS

| | | | |
|---|---|---|---|
| 0430585 | 6/1926 | Fed. Rep. of Germany | 248/281.1 |
| 2742781 | 4/1978 | Fed. Rep. of Germany . | |

*Primary Examiner*—Ramon O. Ramirez

*Attorney, Agent, or Firm*—Cushman, Darby & Cushman

[57] ABSTRACT

The invention is an apparatus for supporting the hand which includes a mounting element detachably attachable to a base. The shaft element is rotatably mounted to the mounting element by a pivot part and a hand support is rotatably attached to the shaft element. The shaft element includes two generally parallel regulation arms spaced distance from each other which are attached at one end to the pivot part and at the other end to a support side pivot part. The hand support is adjustable in height by moving the regulation arms in relation to the mounting element.

4 Claims, 2 Drawing Sheets

DEVICE FOR SUPPORTING OF THE HAND

FIELD OF THE INVENTION

The invention relates to a device for supporting the hand. The device is mounted on a base, preferably on the edge of a table. The device includes a detachably fastened mounting element, rotatably fastened to a lengthy shaft, which is rotatably fastened to a support for the hand.

In working positions, where the arms must be held bent or in some other tense position for a period of time, muscular pains often arise in different muscles. Shoulder and back pain are especially common among those who perform such working tasks as for instance, typing, data processing, or ordinary handwriting. The problem results in occupational diseases and absences from work.

Presently, some hand supports are known which are aimed at giving support to the hands when they are tense in different working tasks. The present devices are, however, difficult to adjust for different persons, and their transverse and height adjustment is not sufficient in cases where the device is used for different working tasks and by different users.

SUMMARY OF THE INVENTION

The purpose of the invention is to bring about a device for supporting the hand which is easy and simple to adjust to a desired position, and which is dependable an operation.

The purpose of the invention is achieved with a device characterized mainly by that which is presented in the patent claims.

According to the invention, the device includes two mainly parallel regulation arms spaced a distance from each other, which are connected at one end with a turning part fastened to a mounting element by a shaft and connected at another end with a support part. The support height can be adjusted by moving the regulation arms in regard to the mounting element. The support retains the whole time in the same attitude during the height adjustment operation.

In a preferred embodiment, a locking mechanism for locking the regulation arms at a desired height is provided. The locking mechanism can be any suitably known device such as a screw or the like. Thus, the motion of the regulation arms is limited and the support is adjusted to the chosen height.

The support side arms of the regulation arms of the device are, in a preferred embodiment, connected to a separate support part, which is in turn, rotatably fastened to a support arm. In this embodiment, the support height can be adjusted in relation to the base by the regulation arms. The horizontal positioning of the support can be adjusted by the turning part and the support arm to various positions in accordance with the needs of the user.

The invention will now be explained in more detail by referring to the attached drawings, which presents one embodiment of the device for supporting the hand in accordance with the invention, as seen from the side.

DETAILED DESCRIPTION OF THE INVENTION

Figure 1:
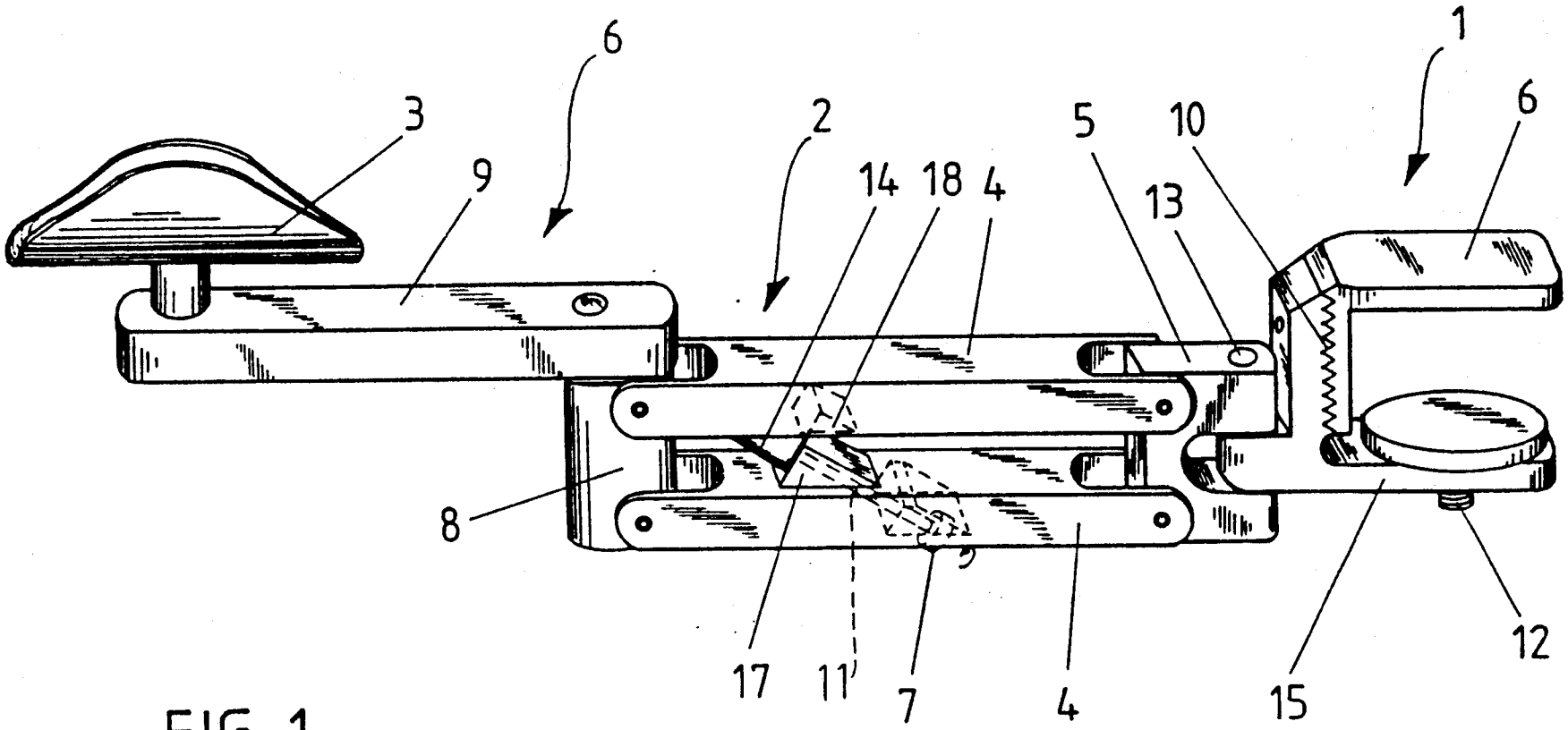
FIG. 1 is a perspective view of a device in accordance with the invention in its lower position.
Figure 2:
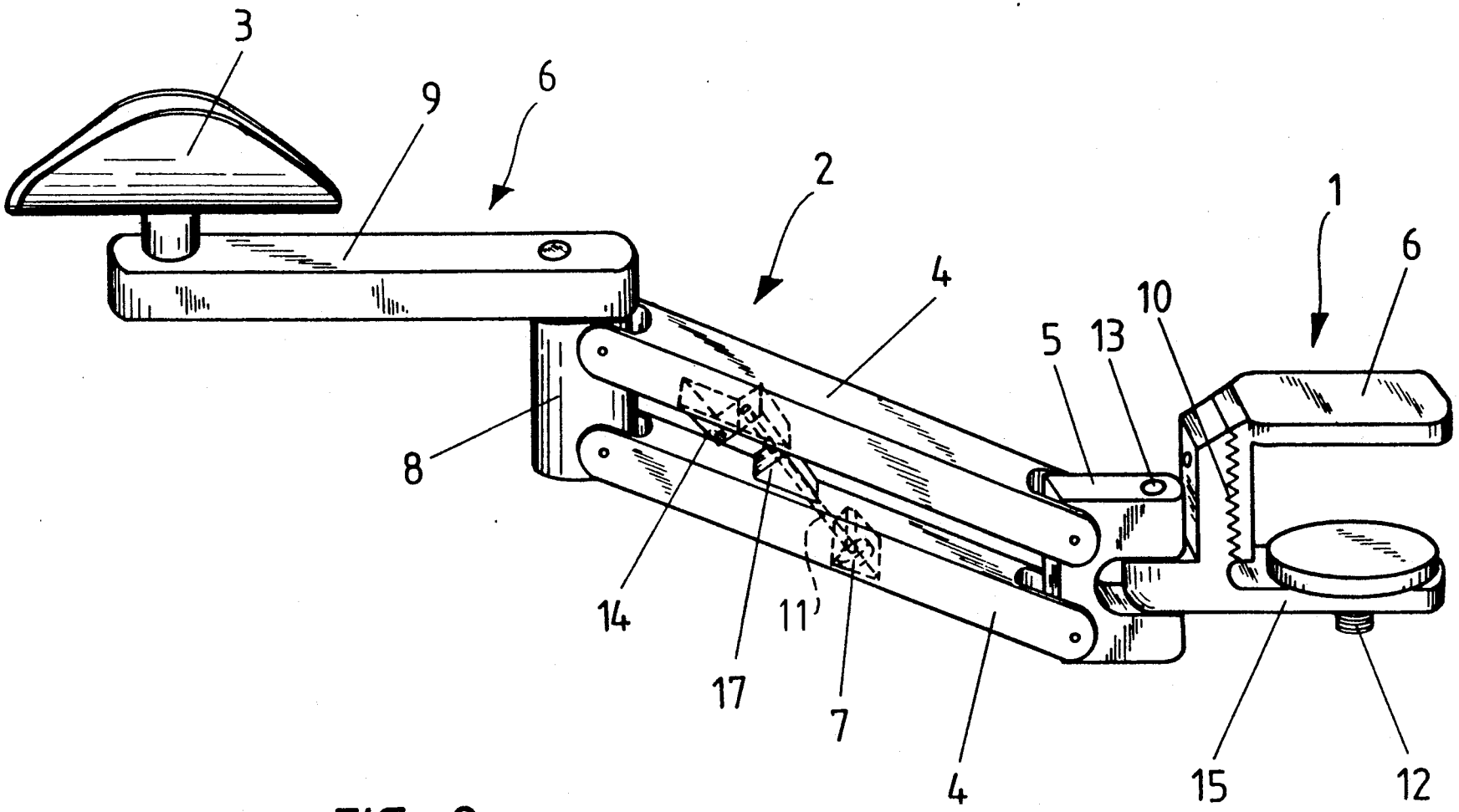
FIG. 2 is a perspective view of the device in accordance with the invention in its upper position.

The embodiment of the device shown in the figures comprises a mounting element 1 for fastening the device to a base. The base used depends on the application of the device. Most commonly, the device is fastened to the edge of a table or to a corresponding object, the mounting element 1 includes a regulating system for adjustment of the height of a shaft of the device in regard to the mounting element 1. The regulating system is formed by tooth edges 10 of two parts 15 and 16 which are placed against each other and fastened together by a fixing screw 11. By means of the tooth edges 10, the mounted element 1 can be suitable preadjusted for different thicknesses of bases prior to fastening the device. The mounting element further comprises a clamping screw 12 fastened to the formed protruding part 15. The corresponding formed protruding part 16 extends in the same direction as protruding part 15. The mounting element 1 is fastened to the base by placing the mounting element 1 such that the edge of the base is positioned between the clamping screw 12 and the protruding part 16 and the clamping screw 12 is tightened.

The mounting element 1 is rotatably attached to a turning part 5 on which a shaft 2 of the device is fastened. The turning part 5 is attached to the mounting element 1 with detachable pin 13 which goes through the turning part 5 and the mounting element 1. On the other side of the turning part 5 two regulating arms 4 are attached at a distance from each other. The other ends of the regulation arms 4 are attached to a support part 8. Regulation arms 4 are attached to the turning part 5 and the support part 8 equal distantly spaced from each other so that they remain parallel to each other. In order to adjust the distance between the regulation arms, and thus, the height of the support device, locking mechanism, which in this embodiment is a locking screw 7, is placed between the regulation arms 4. The locking screw 7 is attached to one regulation arm 4 through a hole in a bossage 17. A protruding support 14 on t he other regulation arm 4 is placed to correspond to the bossage 17 and locking screw 7. The other regulation arm is also formed with a recess 18 to accommodate the bossage 17. When the device is in a lower position, the facing surfaces of the bossage 17 and the protruding support 14 rest against each other. The locking screw 7 is turned in order to adjust the regulation arms to a desired height. The locking screw is set against the protruding support 14 at the desired position and thus prevents the regulation arms 4 from moving downwards. Through adjustment of the locking screw 7, the position of the regulation arms 4 or in other words, their angle in relation of the turning part 5, can be changed to a desired position.

The support part 8 is rotatably fastened to a support arm 9, on the other end of which is rotatably fastened a support 3 for the hand. The support 3 is fastened such that it can move 360° in relation to the support arm 9. The support arm 9 is placed such that it is above the regulation arms 4 and is rotatable 360° in relation to them. Consequently, the support 3 can be turned to a desired spot and position within the range of a semi-circle having a radius formed by the length of the device between the pin 13 and an axis of the support 3.

By detaching the pin 13 between the mounting element 1 and the turning part 5, turning the mounting element 180° and by fastening the part 5 back to the mounting element 1 with the help of fastening pin 13, the shaft of the device is lifted above the level of the base. In this arrangement, the support can be placed in a desired position and spot on an area of a circle formed by the radius of the length of the device between the pin 13 and the axis of the support 3.

In another embodiment of the invention, the device is not provided with a separate support arm 9 but rather, the support 3 for the hand is rotatably fastened to the support part 8. The device is then not adjustable to as wide an area as the previously described device, but functions efficiently in such working tasks in which the extended range is not required.

The invention is not limited to the presented embodiments, but can vary within the limits of the patent claims.

I claim:

1. An apparatus for supporting a human hand, comprising:

a mounting element for detachably mounting to a base;

a shaft arrangement rotatably attached to the mounting element by a pivot part, the shaft arrangement comprising two generally parallel regulation arms positioned at a distance from each other, each regulation arm connected at a first end to the pivot part;

and a support structure rotatably attached to the shaft arrangement such that the support arrangement is adjustable in height by horizontally pivoting the regulation arms in relation to the mounting element, the support structure comprising a support pivot part connected to a second end of each regulation arm, a support arm rotatably attached to the support pivot part, and a hand support rotatably attached to the support arm.

2. An apparatus according to claim 1 further comprising an adjustable locking mechanism positioned between the two regulation arms for locking the regulation arms at a desired height adjustment.

3. An apparatus according to claim 1 wherein the support arm is positioned above the support pivot part and regulation arms such that it is rotatable 360°.

4. An apparatus for supporting a human hand, comprising:

a mounting element for detachably mounting to a base;

a shaft arrangement rotatably attached to the mounting element by a pivot part, the shaft arrangement comprising two generally parallel regulation arms positioned at a distance from each other, each regulation arm connected at a first end to the pivot part;

a support structure rotatably attached to the shaft arrangement such that the support arrangement is adjustable in height by moving the regulation arms in relation to the mounting element; and an adjustable locking mechanism positioned between the two regulation arms for locking the regulation arms at a desired height adjustment, said locking mechanism being a screw mechanism.

* * * * *